US007667670B2

(12) United States Patent
Kitagawa et al.

(10) Patent No.: US 7,667,670 B2
(45) Date of Patent: Feb. 23, 2010

(54) PLASMA DISPLAY DEVICE

(75) Inventors: Mitsushi Kitagawa, Yamanashi-ken (JP); Kazuaki Sakata, Yamanashi-ken (JP); Motofumi Ikeda, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 706 days.

(21) Appl. No.: 11/300,582

(22) Filed: Dec. 15, 2005

(65) Prior Publication Data

US 2006/0158129 A1 Jul. 20, 2006

(30) Foreign Application Priority Data

Dec. 15, 2004 (JP) ..... 2004-362697

(51) Int. Cl.
*G09G 3/28* (2006.01)

(52) U.S. Cl. ..... 345/60; 345/63; 345/55; 345/204

(58) Field of Classification Search ..... 345/60, 345/63, 55, 204
See application file for complete search history.

(56) References Cited

U.S. PATENT DOCUMENTS

2004/0004610 A1 1/2004 Iwami et al.
2004/0008162 A1 * 1/2004 Kim et al. ..... 345/60

FOREIGN PATENT DOCUMENTS

EP 1 164 625 12/2001
JP 07-192630 * 7/1995
JP 1 164 625 A2 * 12/2001
JP 2004-029553 A 1/2004

* cited by examiner

*Primary Examiner*—Richard Hjerpe
*Assistant Examiner*—Leonid Shapiro
(74) *Attorney, Agent, or Firm*—Drinker Biddle & Reath LLP

(57) ABSTRACT

A plasma display which can reduce the cost of a heat dissipating structure for a driver IC. A magnesium oxide layer is formed on a surface in contact with a discharge space in each of display cells of a PDP. The magnesium oxide film includes magnesium oxide crystals which are excited by electron beams irradiated thereto to emit cathode luminescence light having a peak in a wavelength range of 200 to 300 nm. Further, a pixel data pulse generator circuit for applying column electrodes with pixel data pulses in accordance with pixel data is divided into and built in a plurality of IC chips. Each of these IC chips is mounted on one of a plurality of flexible wiring boards which are connected to the power supply line and column electrodes, respectively.

6 Claims, 11 Drawing Sheets

CROSS-SECTION ALONG V3–V3

CROSS-SECTION ALONG W2–W2

PLASMA DISPLAY DEVICE

BACKGROUND OF THE INVENTION

1. Field of the Invention

The present invention relates to a plasma display equipped with a plasma display panel.

2. Description of the Related Art

Plasma display panels (hereinafter called the "PDP") have been developed, and thin large-screen display devices equipped with the PDP rapidly become increasingly popular in recent years as next-generation display devices.

The PDP comprises a plurality of discharge cells serving to be pixels, and a driving integrated circuit device (hereinafter called the "driver IC") mounted therein for generating a variety of driving pulses for causing a discharge to occur in each of these discharge cells. Some known techniques for mounting the driver IC on a board of the PDP employ TCP (Tape Carrier Package based on mounting techniques such as TAB (Tape Automated Bonding), COF (Chip on FPC) and the like (for example, see FIG. 11 in Japanese Patent Kokai No. 2004-29553 (Patent Document 1)).

Here, when a driver IC is mounted in a manner described above, measures are required to be taken for providing a sufficient heat dissipating effect and a simple mounting structure.

However, a radiator must be mounted on the driver IC in order to provide a sufficient heat dissipating effect, resulting in a problem of increasing the weight and price.

SUMMARY OF THE INVENTION

The present invention has been made for solving the foregoing problem, and it is an object of the invention to provide a plasma display device which is capable of reducing the size of or eliminating a radiator mounted on an IC driver for driving a plasma display panel.

A plasma display device according to an aspect of the present invention is a plasma display device for driving, in accordance with pixel data based on an input video signal on a pixel-by-pixel basis, a plasma display panel formed with a capacitive display cell constituting a pixel at each of intersections of a plurality of row electrode pairs with a plurality of column electrodes intersecting with each of the row electrode pairs and extending in the intersecting direction. The plasma display device comprises a magnesium oxide layer formed on a surface in contact with a discharge space in each of the display cells and including a magnesium oxide crystal excited by an electron beam irradiated thereto to emit cathode luminescence light having a peak in a wavelength range of 200 to 300 nm, and a pixel data pulse generator circuit for connecting the column electrodes to a power supply line in accordance with the pixel data to generate a pixel data pulse, and applying the pixel data pulse to the column electrodes, wherein the pixel data pulse generator circuit comprises a plurality of IC chip circuits, and each of the IC chip circuits is mounted on one of a plurality of flexible wiring boards connected to the power supply line and the column electrodes.

A magnesium oxide layer is formed on a surface in contact with a discharge space in each of display cells of a PDP. The magnesium oxide layer includes magnesium oxide crystals which are excited by electron beams irradiated thereto to emit cathode luminescence light having a peak in a wavelength range of 200 to 300 nm. Further, a pixel data pulse generator circuit for applying column electrodes with pixel data pulses in accordance with pixel data is divided into and built in a plurality of IC chips. Each of these IC chips is mounted on one of a plurality of flexible wiring boards which are connected to the power supply line and column electrodes, respectively.

DETAILED DESCRIPTION OF THE INVENTION

In the following, an embodiment of the present invention will be described in detail with reference to the drawings.

Figure 1:
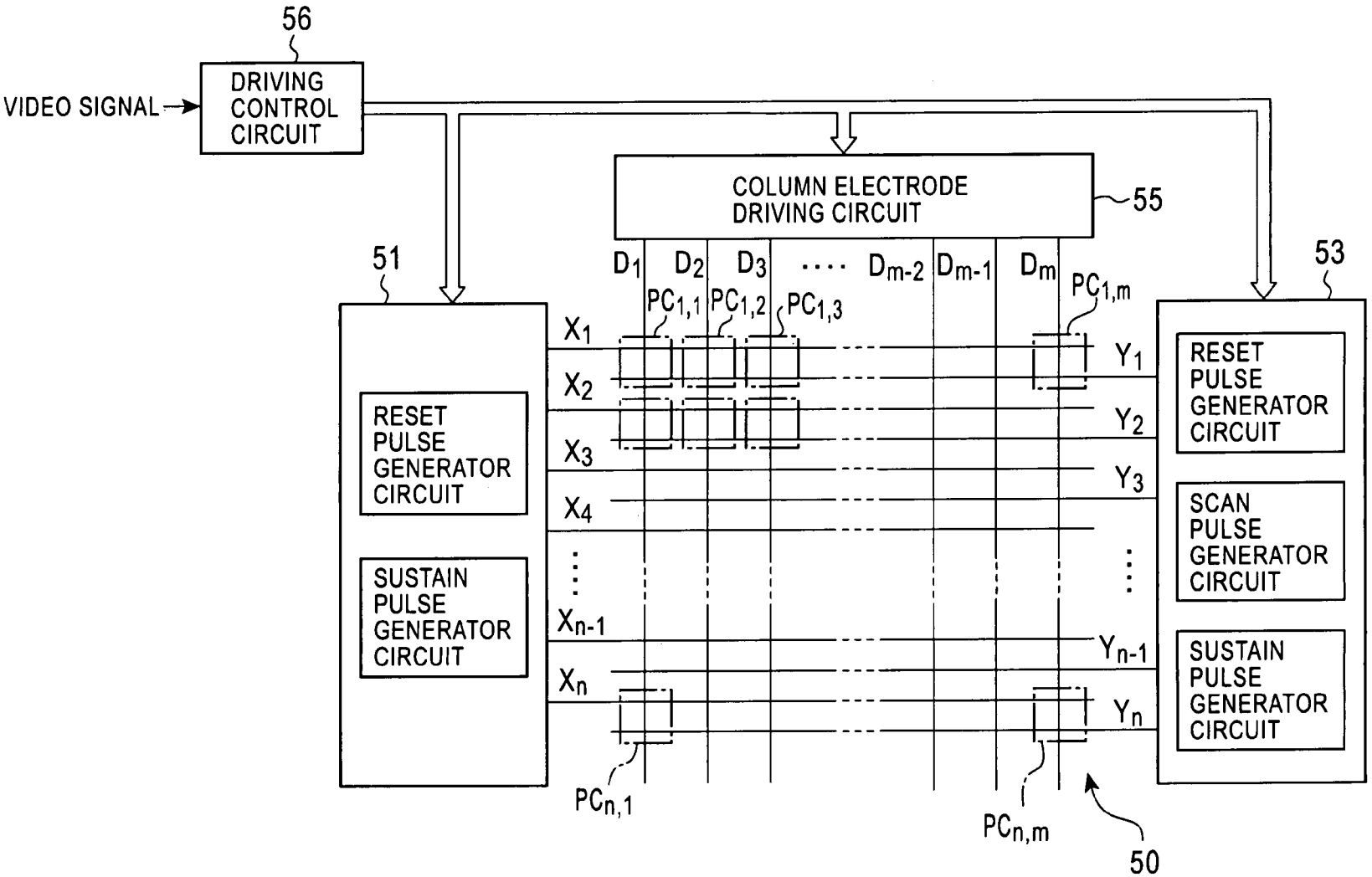
FIG. 1 is a diagram generally showing the configuration of a plasma display device according to the present invention.

FIG. 1 is a diagram generally showing the configuration of a plasma display device according to the present invention.

As shown in FIG. 1, the plasma display device comprises a PDP 50 as a plasma display panel, a row electrode X driving circuit 51, a row electrode Y driving circuit 53, a column electrode driving circuit 55, and a driving control circuit 56.

The PDP 50 is formed with column electrodes $D_1$-$D_m$ each arranged to extend in a lengthwise direction (vertical direction) of a two-dimensional display screen, and row electrodes $X_1$-$X_n$ and row electrodes $Y_1$-$Y_n$ each arranged to extend in a lateral direction (horizontal direction). In this event, each of row electrode pairs $(X_1, Y_1)$, $(X_2, Y_2)$, $(X_3, Y_3)$, . . . , $(X_n, Y_n)$, which are formed in pair by those adjacent to each other, makes up a first display line to an n-th display line on the PDP 50. A display cell PC is formed at each intersecting area (area surrounded by a one-dot chain line in FIG. 1) of each display line with each of the column electrodes $D_1$-$D_m$ for providing a pixel. Specifically, in the PDP 50, each of display cells $PC_{1,1}$-$PC_{1,m}$ belonging to a first display line, display cells $PC_{2,1}$-$PC_{2,m}$ belonging to a second display line, . . . , and display cells $PC_{n,1}$-$PC_{n,m}$ belonging to an n-th display line are arranged in a matrix shape.

Figure 2:
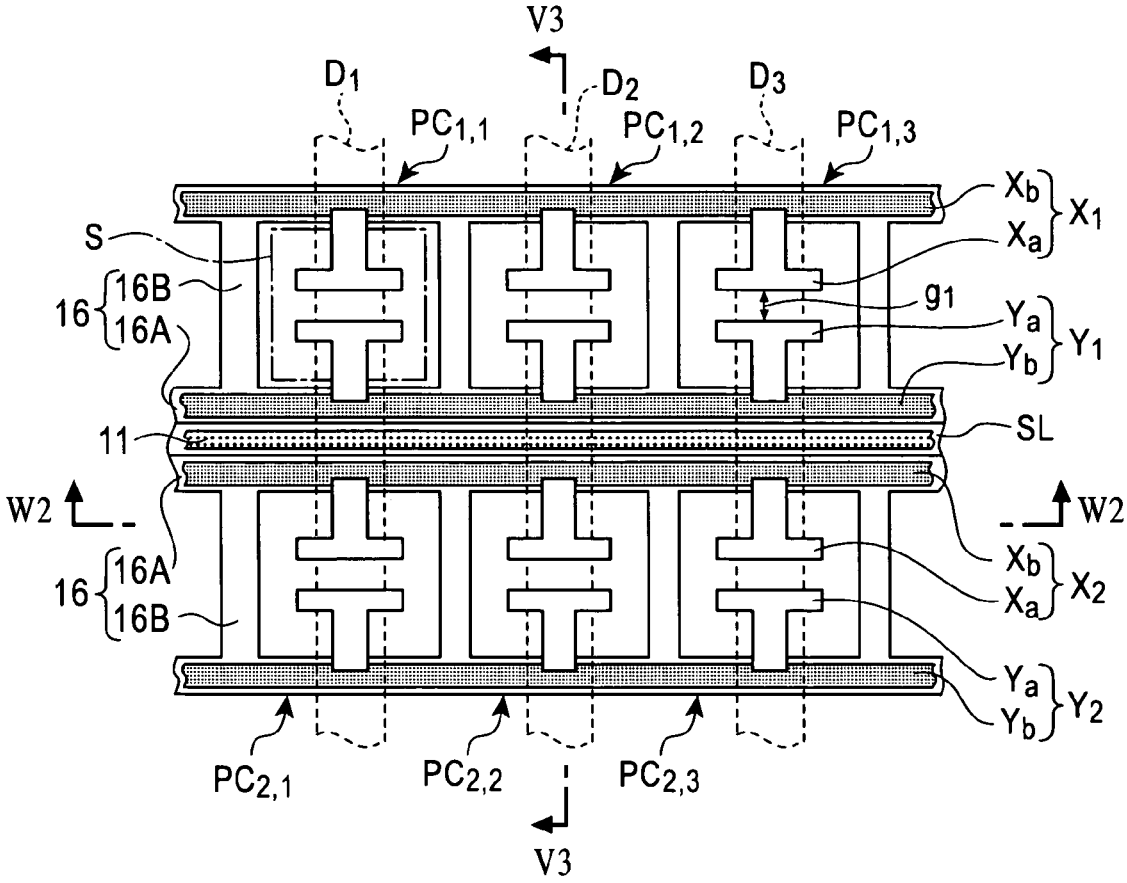
FIG. 2 is a front view schematically showing the internal structure of a PDP 5' mounted in the plasma display device of FIG. 1, when viewed from the display plane side.

FIG. 2 is a front view schematically showing the internal structure of the PDP 50 when viewed from the display plane side.

Figure 3:
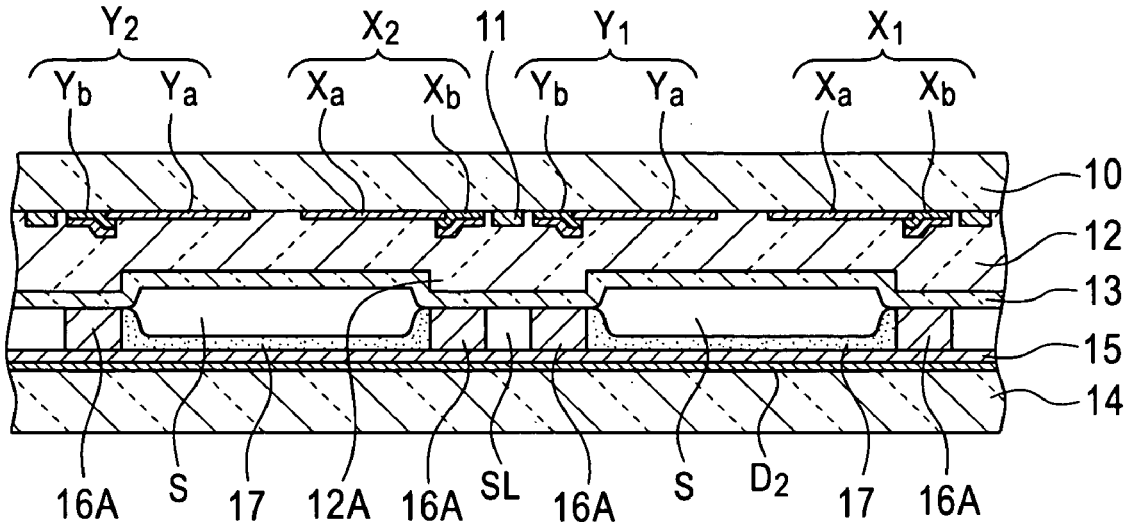
FIG. 3 is a diagram showing a cross-section taken along a V3-V3 line shown in FIG. 2.
Figure 4:
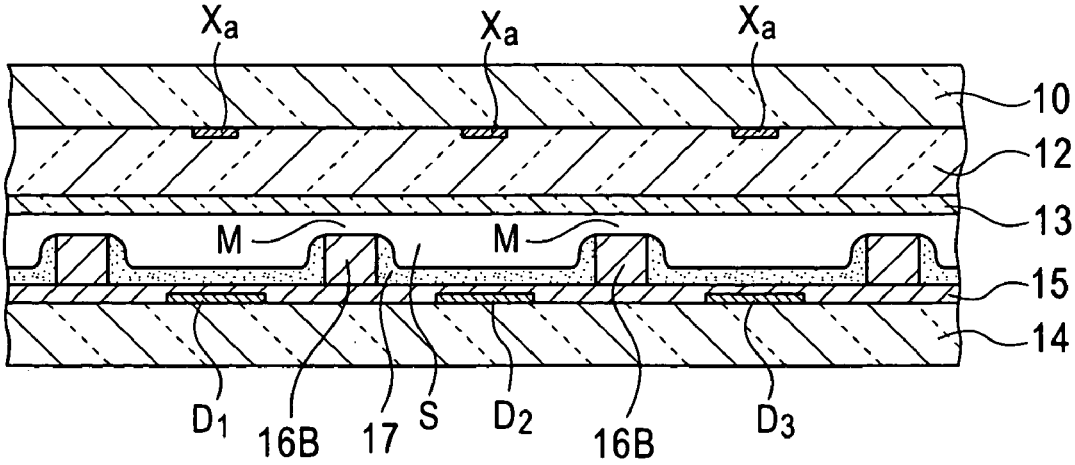
FIG. 4 is a diagram showing a cross-section taken along a line W2-W2 shown in FIG. 2.

In FIG. 2 each of the column electrodes $D_1$-$D_3$, and each intersecting area of the first display line ($Y_1$, $X_1$) and second display line ($Y_2$, $X_2$) are extracted from the PDP 50 for illustration. FIG. 3 is a diagram showing a cross-section of the PDP 50 along a line V3-V3 in FIG. 2, and FIG. 4 is a diagram showing a cross-section of the PDP 50 along a line W2-W2 in FIG. 2.

As shown in FIG. 2, each row electrode X comprises a bus electrode Xb which extends in the horizontal direction of the two-dimensional display screen, and a T-shaped transparent electrode Xa arranged on the bus electrode Xb in contact with a position corresponding to each display cell PC. Each row electrode Y comprises a bus electrode Yb which extends in the horizontal direction of the two-dimensional display screen, and a T-shaped transparent electrode Ya arranged on the bus electrode Yb in contact with a position corresponding to each display cell PC. The transparent electrodes Xa and Ya are made of transparent conductive film, for example, ITO and the like, while the bus electrodes Xb and Yb are made, for example, of metal films. As shown in FIG. 3, the row electrode X composed of the transparent electrode Xa and bus electrode Xb, and the row electrode Y composed of the transparent electrode Ya and bus electrode Yb are formed on the back side of the front transparent board 10, the front side of which is a display plane of the PDP. In this event, the transparent electrodes Xa and Ya in each row electrode pair (X, Y) extend toward the associated row electrode with which it forms a pair, and top sides of their wider areas oppose each other across a discharge gap g1 of a predetermined width. Also, on the back side of the front transparent board 10, a black or dark light absorbing layer (light shielding layer) 11 extending in the horizontal direction of the two-dimensional display screen is formed between the pair of row electrode pair ($X_1$, $Y_1$) and the row electrode pair ($X_2$, $Y_2$) adjacent to this row electrode pair. Further, on the back side of the front transparent electrode 10, a dielectric layer 12 is formed to cover the row electrode pair (X, y). On the back side of the dielectric layer 12 (on a surface opposite to a surface in contact with the row electrode pair), a raised electrode layer 12A is formed in a portion corresponding to the region in which the light absorbing layer 11 and the bus electrodes Xb and Yb adjacent to this light absorbing layer 11 are formed, as shown in FIG. 3. On the surface of the dielectric layer 12 and raised dielectric layer 12*a*, a magnesium oxide layer 13 including magnesium oxide crystals is formed. The magnesium oxide crystals are excited by irradiation of an electron beam, as later described, to give rise to cathode luminescence light emission which has a peak within a wavelength range of 200 to 300 nm.

On the other hand, on a back board 14 arranged in parallel with the front transparent board 10, each of column electrodes D is formed at a position opposite to the transparent electrodes Xa and Ya in each row electrode pair (X, Y) to extend in a direction orthogonal to the row electrode pair (X, Y). On the back board 14, a white column electrode protection layer 15 is further formed to cover the column electrodes D. Partitions 16 are formed on this column electrode protection layer 15. The partitions 16 are formed in a ladder shape by horizontal walls 16A, each of which extends in the horizontal direction of the two-dimensional display screen at positions corresponding to the bus electrodes Xb and Yb of each row electrode pair (X, Y), and vertical walls 16 which extend in the vertical direction of the two-dimensional display screen at each intermediate position between the column electrodes D adjacent to each other. The ladder-shaped partition 16 as shown in FIG. 2 is formed for each of the display lines on the PDP 50, and a gap SL shown in FIG. 2 is defined between the partitions 16 adjacent to each other. Also, the ladder-shaped partitions 16 define display cells PC each including an independent discharge space S, and transparent electrodes Xa and Ya. Within the discharge space S, a discharge gas including Xenon gas is encapsulated. A fluorescent layer 17 is formed on a side surface of the horizontal wall 16A, a side surface of the vertical wall 16B, and the surface of the column electrode protection layer 15 to cover all of these surfaces, as shown in FIG. 3. Actually, the fluorescent layer 17 is made up of three kinds of fluorescent materials which include a fluorescent material that presents red light emission, a fluorescent material that presents green light emission, and a fluorescent material that presents blue light emission. The spacing between the discharge space S and the gap SL of each display cell PC is closed by the magnesium oxide layer 13 in abutment to the horizontal wall 16A, as shown in FIG. 3. On the other hand, since the vertical wall 16B is not in abutment to the magnesium oxide layer 13 as shown in FIG. 4, a gap r1 is defined in between. In other words, the discharge spaces S of the respective display cells PC adjacent to each other in the horizontal direction of the two-dimensional display screen communicate with each other through the gap r1.

Figure 6:
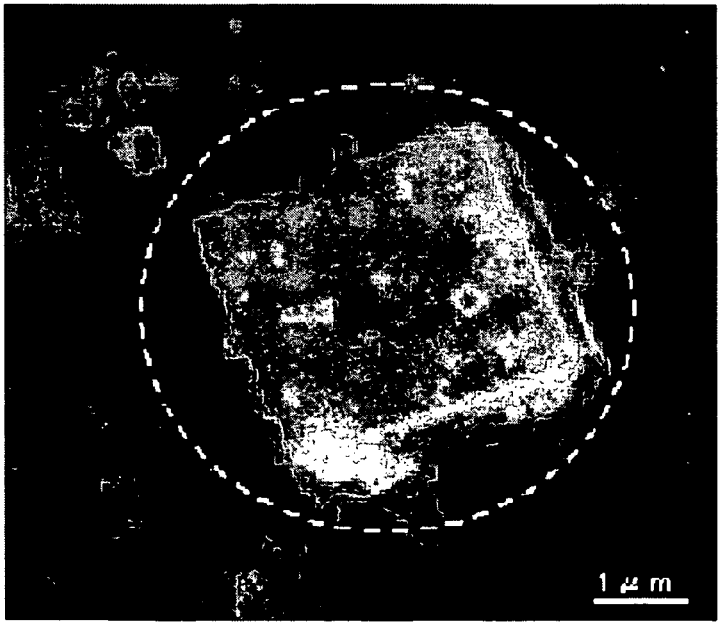
FIG. 6 is a diagram showing an example of magnesium oxide single crystal.
Figure 7:
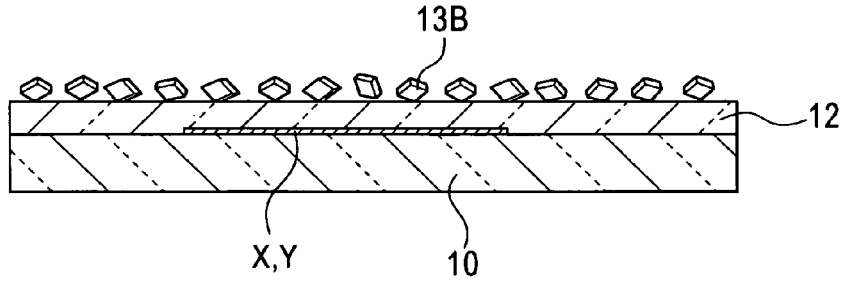
FIG. 7 is a diagram showing how a magnesium oxide layer is formed when magnesium oxide single crystals are applied on the surface of a dielectric layer and a raised dielectric layer.

Here, the magnesium oxide crystals, which make up the magnesium oxide layer 13, include single crystals which are produced by oxidizing a magnesium vapor generated by heating magnesium in vapor phase, for example, vapor-phase based magnesium oxide crystals which are excited by irradiation of an electron beam to present CL emission having a peak in a wavelength range of 200 to 300 nm (particularly, near 235 nm within 230 to 250 nm). The vapor-phase based magnesium oxide crystals include magnesium single crystals with a grain diameter equal to or larger than 2000 angstrom, which have a multi-crystal structure in which cubic crystals as shown in a SEM photographic image of FIG. 5 fit into one another, or a single-crystal structure as shown in a SEM photographic image of FIG. 6. Such magnesium single crystals have features of being highly pure and fine grains, with less aggregation of grains, as compared with magnesium oxide produced by other methods, and contributes to improvements in discharge characteristics such as a discharge delay and the like, as later described. For reference, this embodiment employs vapor-phase magnesium oxide single crystals having an average grain diameter of 500 angstrom or more, and preferably 2000 angstrom or more, as measured by the BET method. Then, such magnesium oxide single crystals are applied onto the surface of the dielectric layer 12, as shown in FIG. 7, by a spray method, an electrostatic coating method or the like to form the magnesium oxide layer 13. Alternatively, the magnesium oxide layer 13 may be formed by forming a thin-film magnesium oxide layer by vapor deposition or sputtering method on the surface of the dielectric layer 12 and raised dielectric layer 12A, and applying vapor-phase based magnesium oxide single crystals on the thin-film magnesium oxide layer.

Figure 8:
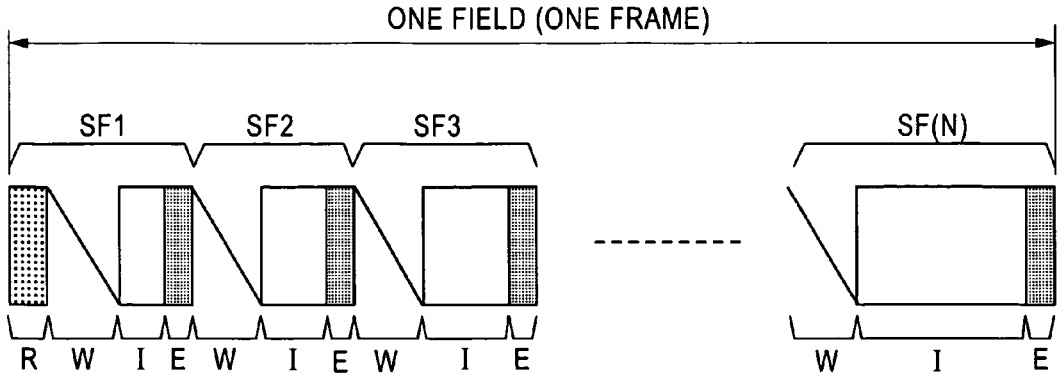
FIG. 8 is a diagram showing an example of a light emission driving sequence employed in the plasma display device shown in FIG. 1.

The driving control circuit 56 supplies each of the row electrode X driving circuit 51, row electrode Y driving circuit 53, and column electrode driving circuit 55 with a variety of control signals such that the PDP 50 having the foregoing structure is driven in accordance with a light emission driving sequence which employs a sub-field method as shown in FIG. 8. In the light emission driving sequence shown in FIG. 8, in each of N sub-fields SF1-SF(N) within one field (one frame) of display period, an addressing stage W, a sustain stage I, and an erasure stage E are performed in sequence. However, only in the first sub-field SF1, a reset stage R is performed prior to the addressing stage W. The driving control circuit 56, when conducting a control based on the light emission driving sequence, generates (m) pixel driving data bits DB for each display line at a time to specify whether or not each of the display cells PC is driven to emit light in each addressing stage W in accordance with pixel data for each pixel based on an input video signal, and supplies the pixel driving data bits DB1 to the column electrode driving circuit 55.

The row electrode X driving circuit 51 comprises a reset pulse generator circuit, and a sustain pulse generator circuit. The reset pulse generator circuit of the row electrode X driving circuit 51 generates a reset pulse (later described) which should be applied to the row electrodes X of the PDP 50 in the reset stage R. The sustain pulse generator circuit of the row-electrode X driving circuit 51 generates a sustain pulse (later described) which should be applied to the row electrodes X in the sustain stage I. The row-electrode Y driving circuit 53 comprises a reset pulse generator circuit, a scan pulse generator circuit, and a sustain pulse generator circuit. The reset pulse generator circuit of the row electrode Y driving circuit 53 generates a reset pulse (later described) which should be applied to the row electrodes Y of the PDP 50 in the reset stage R. The scan pulse generator circuit of the row-electrode Y driving circuit 53 generates a scan pulse (later described) which should be applied to the row electrodes Y of the PDP 50 in the addressing stage W. The sustain pulse generator circuit of the row electrode Y driving circuit 53 generates a sustain pulse (later described) which should be applied to the row electrodes Y in the sustain stage I.

The column electrode driving circuit 55 generates a pixel data pulse which should be applied to the column electrodes D of the PDP 50 in the addressing stage W.

Figure 9:
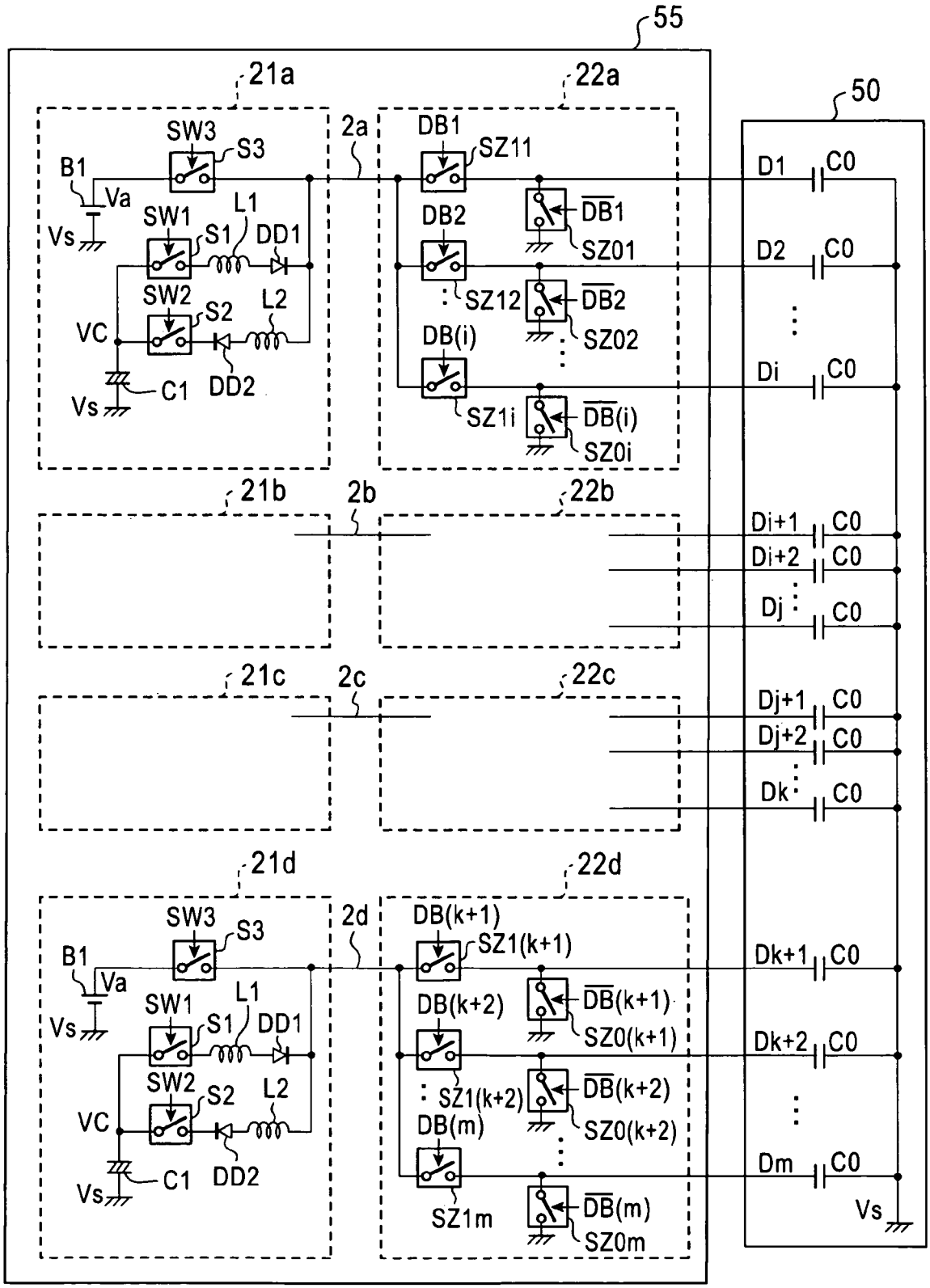
FIG. 9 is a diagram showing the internal configuration of a column electrode driving circuit 55 shown in FIG. 1.

FIG. 9 is a diagram showing the internal configuration of the column electrode driving circuit 55.

As shown in FIG. 9, the column electrode driving circuit 55 comprises resonance pulse power supply circuits 21*a*-21*d*, and pixel data pulse generator circuits 22*a*-22*d*.

Each of the resonance pulse power supply circuits 21*a*-21*d* comprises a DC power supply B1, a capacitor C1, switching elements SW1-SW3, coils L1, L2, and diodes DD1, DD2, and has the same circuit configuration to one another. The capacitor C1 has one end connected to a PDP ground potential Vs as a ground potential of the PDP 50. The switching element S1 remains in an off-state while it is supplied with a switching signal SW1 at logical level "0" from the driving control circuit 56. On the other hand, when the switching signal SW1 is at logical level "1," the switching element S1 turns on to apply a potential generated at the other end of the capacitor C1 to a power supply line 2 through the coil L1 and diode DD1. The switching element S2 remains in an off-state while it is supplied with a switching signal SW2 at logical level "0" from the driving control circuit 56. On he other hand, when the switching signal SW2 is at logical level "1," the switching element S2 turns on to apply a potential on the power supply line 2 to the other end of the capacitor C1 through the coil L2 and diode DD2. In this event, the capacitor C1 is charged by the potential on the power supply line 2. The switching element S3 remains in an off-state while it is supplied with a switching signal SW4 at logical level "0" from the driving control circuit 56. On the other hand, when the switching signal SW3 is at logical level "1," the switching element S3 turns on to apply a DC supply voltage Va, generated by the DC power supply B1, onto the power supply line 2.

Figure 10A:
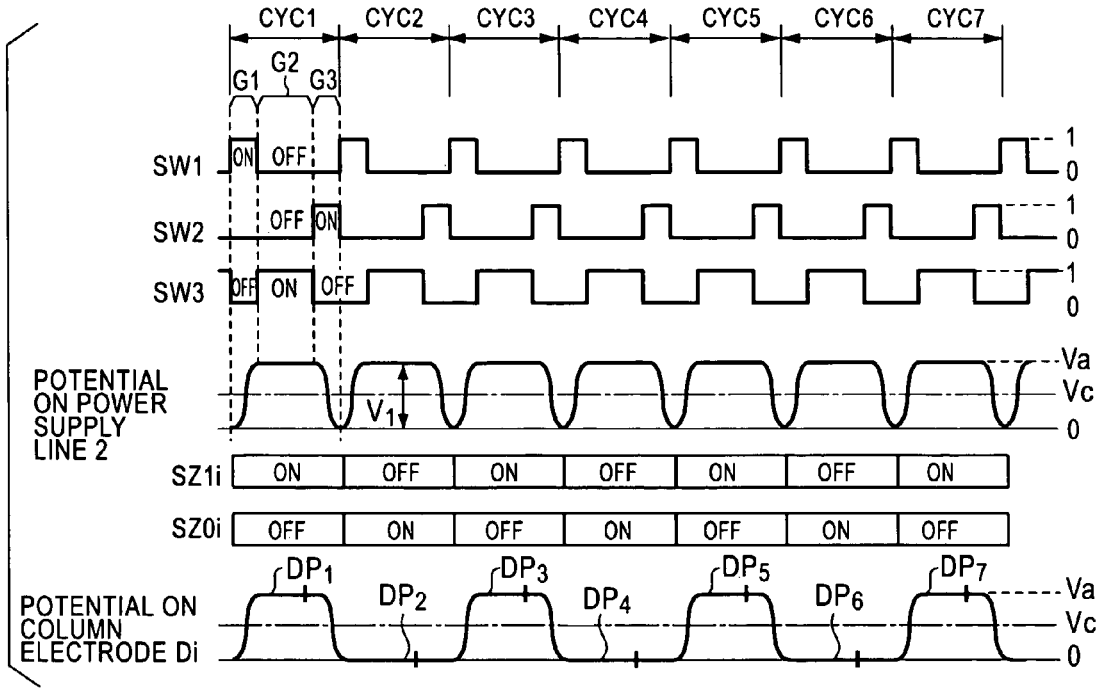
FIGS. 10A to 10C are diagrams for describing the internal operation of the column electrode driving circuit 55.
Figure 10B:
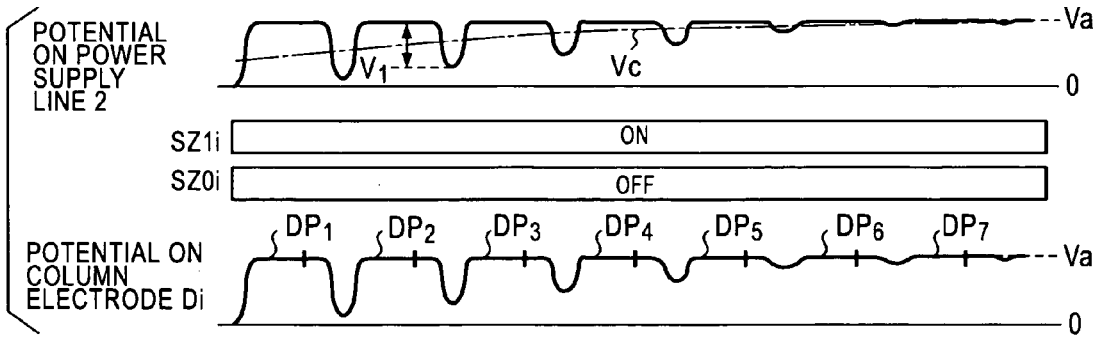
Figure 10C:
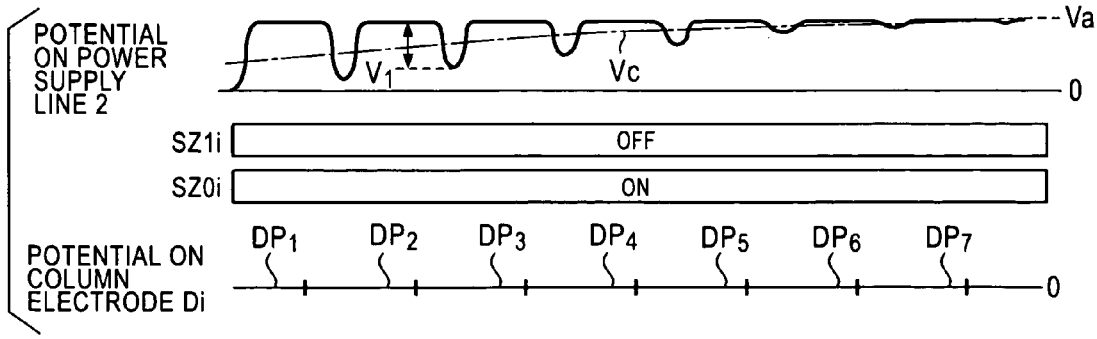

Each of the resonance pulse power supply circuits 21*a*-21*d* generates a resonance pulse supply voltage having a predetermined amplitude in accordance with the switching signals SW1-SW3 based on a sequence shown by driving stages G1-G3 in FIGS. 10A to 10C, and applies the resonance pulse supply voltage to the power supply lines 2*a*-2*d*.

First, in the driving stage G1 shown in FIG. 10A, the switching element S1 alone turns on among switching elements S1-S3, causing a charge accumulated on the capacitor C1 to discharge. In this event, if a switching element SZ1 (later described) of the pixel data pulse generator circuit 22 is in an on-state, a discharge current associated with the discharge flows into the column electrode D of the PDP 50 through a discharge current path comprising the switching element S1, coil L1, and diode DD1, as shown in FIG. 8, power supply line 2, and switching element SZ1. A load capacitance C0 parasitic to the column electrode D is charged with the discharge current, resulting in accumulation of a charge within this load capacitance Co. Then, with a resonance action produced by the coil L1 and load capacitance C0, the potential on the power supply line 2 gradually increases, and reaches a potential Va which has a potential twice the potential Vc at one end of the capacitor C1. In this event, a slow potential rise on the power supply line 2 is a front edge of the resonance pulse supply voltage.

Next, in the driving stage G2, the switching element S3 alone turns on among the switching elements S1-S3 to apply the DC potential Va by the DC power supply B1 onto the power supply line 2 through the switching element S3. In this event, if the switching element SZ1 (later described) of the pixel data pulse generator circuit 22 is in an on-state, a current based on the DC potential Va flows into the column electrode D of the PDP 50 through the switching element SZ1 to charge the load capacitance Co parasitic to the column electrode D. This charging results in accumulation of a charge on the load capacitance Co.

Then, in the driving stage G3, the switching element S2 alone turns on among the switching elements S1-S3, causing the load capacitance C0 parasitic to the column electrode D to start a discharge. This discharge causes a current to flow into the capacitor C1 through the column electrode D, switching element SZ1, power supply line 2, and a charge current path comprising the coil L2, diode DD2, and switching element S2. In other words, the charge accumulated on the load capacitance C0 of the PDP 50 is recovered by the capacitor C1 of the resonance pulse power supply circuit 21. In this event, the potential on the power supply line 2 gradually decreases in accordance with a time Constance which is determined by the coil L2 and load capacitance Co. In this event, a slow potential decrease on the power supply line 2 is a rear edge of the resonance pulse supply voltage.

Each of the resonance pulse power supply circuits 21*a*-21*d* supplies each of the pixel data pulse generator circuits 22*a*-22*d* with the resonance pulse supply voltage generated by the execution of the driving sequence (G1-G3) as described above through the power supply lines 2*a*-2*d*, respectively.

The pixel data pulse generator circuit 22*a* comprises switching elements $SZ1_1$-$SZ1_i$ and $SZ0_1$-$SZ0_i$ which are independently controlled to turn on/off in accordance with pixel driving data bits DB1-DB(i) corresponding to each of the first to i-th columns within the (m) pixel driving data bits DB for one display line supplied from the column electrode driving circuit 55. Each of the switching elements $SZ1_1$-$SZ1_i$ turns on when the pixel driving data bit DB1-DB(i) supplied thereto is at logical level "1" to apply the column electrodes $D_1$-$D_i$ of the PDP 50 with the resonance pulse supply voltage supplied from the resonance pulse power supply circuit 21*a* through the power supply line 2*a*. Each of the switching elements $SZ0_1$-$SZ0_i$ turns on when the pixel driving data bit DB1-DB(i) is at logical "0" to force the potential on the column electrode $D_1$-$D_i$ down to the PDP ground potential Vs. With this operation, the pixel data pulse generator circuit 22*a* generates a pixel data pulse at high voltage which is applied to the column electrodes $D_1$-$D_i$, respectively, only when the pixel driving data bits DB1-DB(i) are at logical level "1." When the pixel driving data bits DB1-DB(i) are at logical level "0," the pixel data pulse generator circuit 22*a* applies a low potential (zero volt) to the column electrodes $D_1$-$D_i$, respectively.

The pixel data pulse generator circuit 22*b* comprises switching elements $SZ1_{(i+1)}$–$SZ1_j$ and $SZ0_{(i+1)}$–$SZ0_j$ which are independently controlled to turn on/off in accordance with pixel driving data bits DB(i+1)–DB(j) corresponding to each of the (i+1)th to j-th columns within the (m) pixel driving data bits DB for one display line supplied from the column electrode driving circuit 55. Each of the switching elements $SZ1_{(i+1)}$–$SZ1_j$ turns on when the pixel driving data bit DB(i+1)–DB(j) supplied thereto is at logical level "1" to apply the column electrodes $D_{(i+1)}$–$D_j$ of the PDP 50 with the resonance pulse supply voltage supplied from the resonance pulse power supply circuit 21*b* through the power supply line 2*b*. Each of the switching elements $SZ0_{(i+1)}$–$SZ0_j$ turns on when the pixel driving data bit DB(i+1)–DB(j) is at logical "0" to force the potential on the column electrode $D_{(i+1)}$–$D_j$ down to the PDP ground potential Vs. With this operation, the pixel data pulse generator circuit 22*b* generates a pixel data pulse at high voltage which is applied to the column electrodes $D_{(i+1)}$–$D_j$, respectively, only when the pixel driving data bits DB(i+1)–DB(j) are at logical level "1." When the pixel driving data bits DB(i+1)–DB(j) are at logical level "0," the pixel data pulse generator circuit 22*b* applies a low potential (zero volt) to the column electrodes $D_{(i+1)}$–($D_j$, respectively.

The pixel data pulse generator circuit 22*c* comprises switching elements $SZ1_{(j+1)}$–$SZ1_k$ and $SZ0_{(j+1)}$–$SZ0_k$ which are independently controlled to turn on/off in accordance with pixel driving data bits DB(j+1)–DB(k) corresponding to each of the (j+l)th to K-th columns within the (m) pixel driving data bits DB for one display line supplied from the column electrode driving circuit 55. Each of the switching elements $SZ1_{(j+1)}$–$SZ1_k$ turns on when the pixel driving data bit DB(j+1)–DB(k) supplied thereto is at logical level "1" to apply the column electrodes $D_{(j+1)}$–$D_k$ of the PDP 50 with the resonance pulse supply voltage supplied from the resonance pulse power supply circuit 21*c* through the power supply line 2*c*. Each of the switching elements $SZ0_{(j+1)}$–$SZ0_k$ turns on when the pixel driving data bit DB(j+1)–DB(k) is at logical "0" to force the potential on the column electrode $D_{(j+1)}$–$D_k$ down to the PDP ground potential Vs. With this operation, the pixel data pulse generator circuit 22*c* generates a pixel data pulse at high voltage which is applied to the column electrodes $D_{(j+1)}$–$D_k$, respectively, only when the pixel driving data bits DB(j+1)–DB(k) are at logical level "1." When the pixel driving data bits DB(j+1)–DB(k) are at logical level "0," the pixel data pulse generator circuit 22*c* applies a low potential (zero volt) to the column electrodes $D_{(j+1)}$–$D_k$, respectively.

The pixel data pulse generator circuit 22*c* comprises switching elements $SZ1_{(k+1)}$–$SZ1_m$ and $SZ0_{(k+1)}$–$SZ0_m$ which are independently controlled to turn on/off in accordance with pixel driving data bits DB(k+1)–DB(m) corresponding to each of the (k+1)th to m-th columns within the pixel driving data bits DB for one display line (m) supplied from the column electrode driving circuit 55. Each of the switching elements $SZ1_{(k+1)}$–$SZ1_m$ turns on when the pixel driving data bit DB(k+1)–DB(m) supplied thereto is at logical level "1" to apply the column electrodes $D_{(k+1)}$–$D_m$ of the PDP 50 with the resonance pulse supply voltage supplied from the resonance pulse power supply circuit 21*d* through the power supply line 2*d*. Each of the switching elements $SZ0_{(k+1)}$–$SZ0_m$ turns on when the pixel driving data bit DB(k+1)–DB(m) is at logical "0" to force the potential on the column electrode $D_{(k+1)}$–$D_m$ down to the PDP ground potential Vs. With this operation, the pixel data pulse generator circuit 22*d* generates a pixel data pulse at high voltage which is applied to the column electrodes $D_{(k+1)}$–$D_m$, respectively, only when the pixel driving data bits DB(k+1)–DB(m) are at logical level "1." When the pixel driving data bits DB(k+1)–DB(m) are at logical level "0," the pixel data pulse generator circuit 22*d* applies a low potential (zero volt) to the column electrodes $D_{(k+1)}$–$D_m$, respectively.

The resonance pulse power supply circuits 21*a*-21*d* and pixel data pulse generator circuits 22*a*-22*d* are mounted in the PDP 50 in a form as shown in FIG. 10.

Figure 11:
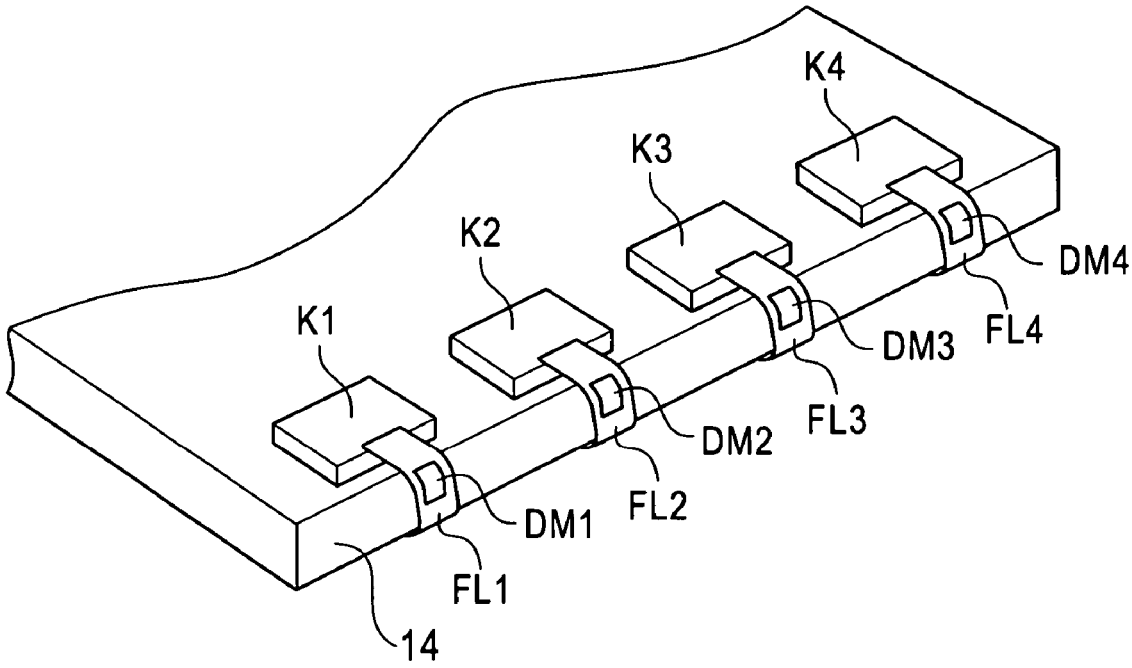
FIG. 11 is a diagram showing an embodiment of the column electrode driving circuit 55.

In FIG. 11, the resonance pulse power supply circuit 21*a* is built on a circuit board K1, while the resonance pulse power supply circuit 21*b* is built on a circuit board K2. Also, the resonance pulse power supply circuit 21*c* is built on a circuit board K3, while the resonance pulse power supply circuit 21*d* is built on a circuit board K4. Each of these circuit boards K1-K4 is mounted on one surface of a chassis (not shown) to which the back board 14 of the PDP 50 is fixedly supported. On the other side of the back board 14, the column electrodes $D_1$-$D_m$ are arranged as mentioned above. The circuit board K1 is connected to an extension (not shown) of the back board 14 through a flexible cable FL1. On this flexible cable FL1, a driver module DM1 is provided as implemented in an IC chip which integrates the pixel data pulse generator circuit 22*a* therein. The flexible cable FL1 contains a power supply line corresponding to the power supply line 2*a* shown in FIG. 8, and i transmission lines for transmitting pixel data pulses generated by the pixel data pulse generator circuit 22*a* to the column electrodes $D_1$-$D_i$, respectively. Also, the circuit board K2 is connected to the back board 14 through a flexible cable FL2. On this flexible cable FL2, a driver module DM2 is provided as implemented in an IC chip which integrates the pixel data pulse generator circuit 22*b* therein. The flexible cable FL2 contains a power supply line corresponding to the power supply line 2*b* shown in FIG. 8, and (j-i) transmission lines for transmitting pixel data pulses generated by the pixel data pulse generator circuit 22*b* to the column electrodes $D_{(i+1)}$–$D_j$, respectively. Also, the circuit board K3 is connected to the back board 14 through a flexible cable FL3. On this flexible cable FL3, a driver module DM3 is provided as implemented in an IC chip which integrates the pixel data pulse generator circuit 22*c* therein. The flexible cable FL3 contains a power supply line corresponding to the power supply line 2*c* shown in FIG. 8, and (k-j) transmission lines for transmitting pixel data pulses generated by the pixel data pulse generator circuit 22*c* to the column electrodes $D_{(j+1)}$–$D_k$, respectively. Also, the circuit board K4 is connected to the back board 14 through a flexible cable FL4. On this flexible cable FL4, a driver module DM4 is provided as implemented in an IC chip circuit which integrates the pixel data pulse generator circuit 22*d* therein. The flexible cable FL4 contains a power supply line corresponding to the power supply line 2*d* shown in FIG. 8, and (m-k) transmission lines for transmitting pixel data pulses generated by the pixel data pulse generator circuit 22*d* to the column electrodes $D_{(k+1)}$–$D_m$, respectively.

Figure 12:
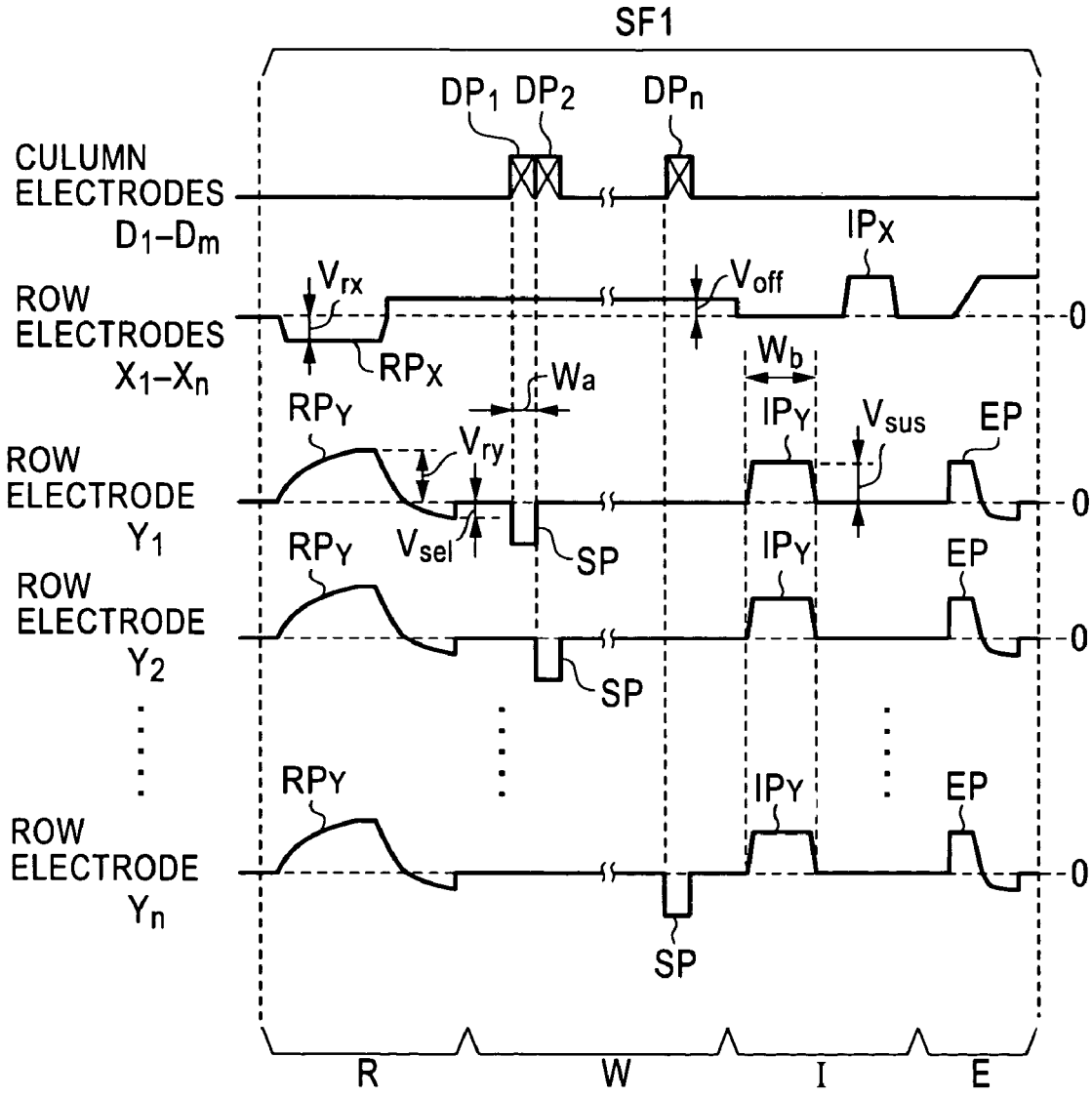
FIG. 12 is a diagram showing a variety of driving pulses applied to the PDP in accordance with the light emission driving sequence shown in FIG. 7, and timings at which the driving pulses are applied.

FIG. 12 is a diagram showing application timings for a variety of driving pulses applied to the column electrodes D and row electrodes X, Y of the PDP 50 in a sub-field SF1 extracted from sub-fields SF1 -SF(N).

First, in a reset stage R, the row electrode Y driving circuit 53 simultaneously applies row electrodes $Y_1$-$Y_n$ with a reset pulse $RP_Y$ which has a front edge at which a voltage on the row electrode Y slowly increases over time to reach a positive peak voltage value Vry, and a rear edge at which the voltage value subsequently decreases slowly to reach a negative voltage value Vsel. The voltage value Vsel is a voltage between a voltage value on the row electrode Y when a negative scan pulse (later described) is applied, and a voltage value on the row electrode Y when any voltage is not applied thereto. The peak voltage value Vry is a voltage value higher than a voltage value on the row electrode Y when a sustain pulse, later described, is applied thereto. The row electrode X driving circuit 51 applies the electrodes $X_1$-$X_n$ with a reset pulse $RP_X$, which has a negative voltage Vrx as shown in FIG. 12, over a section in which the voltage value increases in the reset pulse $RP_Y$.

Here, when the reset pulse $RP_X$ is applied together with the reset pulse $RP_Y$, a faint write reset pulse is produced between the row electrodes X and Y in each of all the display cells $PC_{1,1}$-$PC_{n,m}$. After the end of the write reset discharge, a predetermined wall charge is formed on the surface of the magnesium oxide layer 13 within the discharge space S of each display cell PC. Specifically, a positive charge is formed near the row electrode X on the surface of the magnesium oxide layer 13, while a negative charge is formed near the row electrode Y, thus resulting in the formation of the so-called wall charge. Subsequently, as the voltage of the reset pulse $RP_Y$ slowly decreases from the peak voltage value Vry, a faint erasure reset discharge is produced between the row electrodes X and Y within each of all the display cells $PC_{1,1}$-$PC_{n,m}$. The erasure reset discharge causes the extinction of the wall charge which has been formed in each of all the display cells $PC_{1,1}$-$PC_{n,m}$. In other words, by the reset stage R, each of all the display cells $PC_{1,1}$-$PC_{n,m}$ is initialized to a so-called extinction mode state in which the amount of wall charge falls short of a predetermined amount.

Next, in the addressing stage W, the column electrode driving circuit 55 generates pixel data pulses having voltages corresponding to the pixel drive data bits DB supplied from the driving control circuit 56, and sequentially applies them (m pulses) for one display line at a time to the column electrodes $D_1$-$D_m$ as pixel data pulse groups $DP_1$, $DP_2$, . . . , $DP_n$. In the meantime, the row electrode Y driving circuit 53 sequentially applies a negative scan pulse SP to the row electrodes $Y_1$-$Y_n$ in synchronism with the timing of each of the pixel data pulse groups $DP_1$-$DP_n$. In this event, an addressing discharge is produced only in a display cell PC which is applied with the scan pulse SP and also applied with a pixel data pulse at high voltage, causing a predetermined amount of wall charge to be formed on the surface of each of the magnesium oxide layer 13 and fluorescent layer 17 within the discharge space S of the display cell PC. On the other hand, the addressing discharge as mentioned above is not produced in a display cell PC which is applied with the scan pulse SP but is applied with a pixel data pulse at low voltage, so that the formation of the wall charge is maintained to be the same as that immediately before the application of the pulses. In other words, with the execution of the addressing stage W, each display cell PC is set to either a lighting mode in which a predetermined amount of wall charge exists or a extinction mode in which the predetermined amount of wall charge does not exist, based on an input video signal.

Next, in the sustain stage I, the row electrode X driving circuit 51 and row electrode Y driving circuit 53 alternately apply the row electrodes $X_1$-$X_n$ and $Y_1$-$Y_n$ with the positive sustain pulses $IP_X$, $IP_Y$, respectively, in repetition. The number of times the sustain pulses $IP_X$, $IP_Y$ are applied depends on weighting of luminance in each sub-field. In this event, each time these sustain pulses $IP_X$, $IP_Y$ are applied, a sustain discharge is produced only in a display cell PC which is set in the lighting mode state where a predetermined amount of wall charge is formed therein, and the fluorescent layer 17 emits light, associated with the discharge, to form an image on the panel plane.

Next, in the erasure stage E, the row electrode Y driving circuit 53 simultaneously applies a positive erasure pulse EP to all the row electrodes $Y_1$-$Y_n$. The application of the erasure pulse EP causes an erasure discharge in all the display cells PC, resulting in extinction of all the wall charges which remain in the respective display cells PC.

Figure 5:
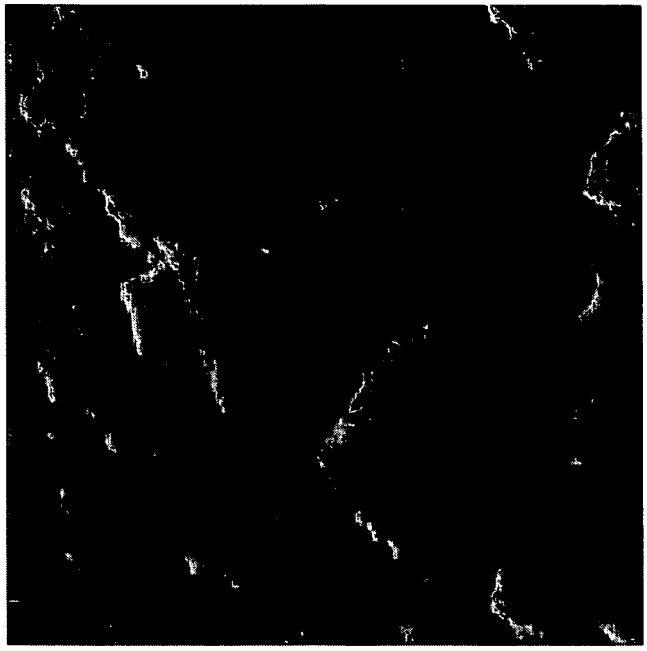
FIG. 5 is a diagram showing an example of magnesium oxide single crystal.
Figure 13:
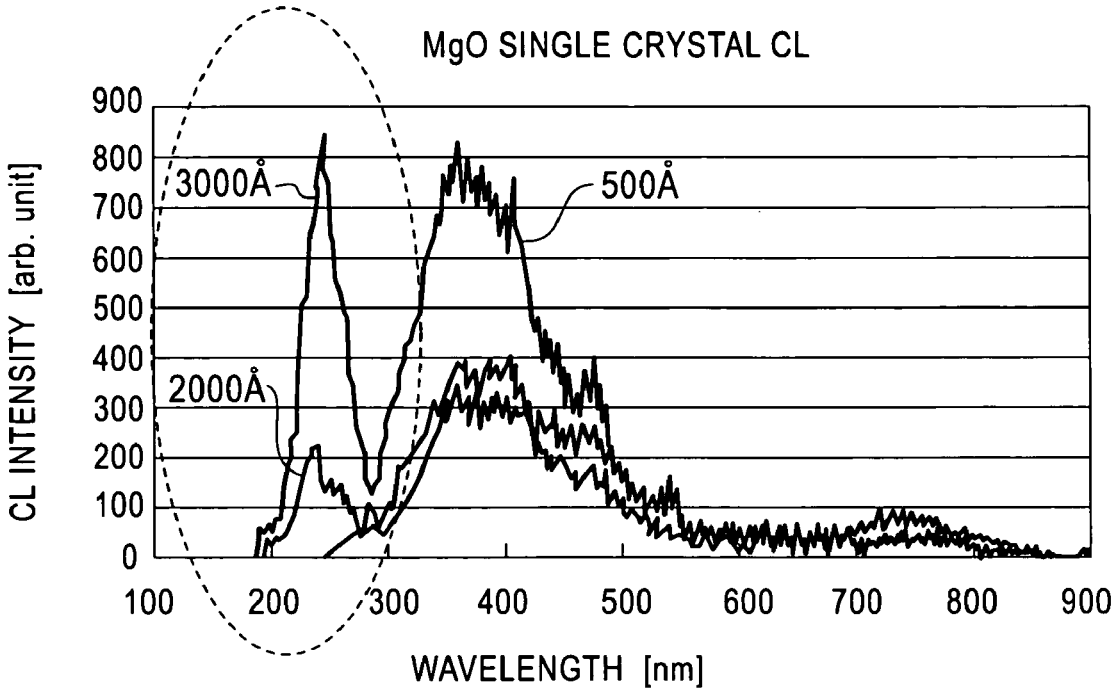
FIG. 13 is a graph showing the relationship between the grain diameter of magnesium oxide single crystal and the wavelength of CL light emission.
Figure 14:
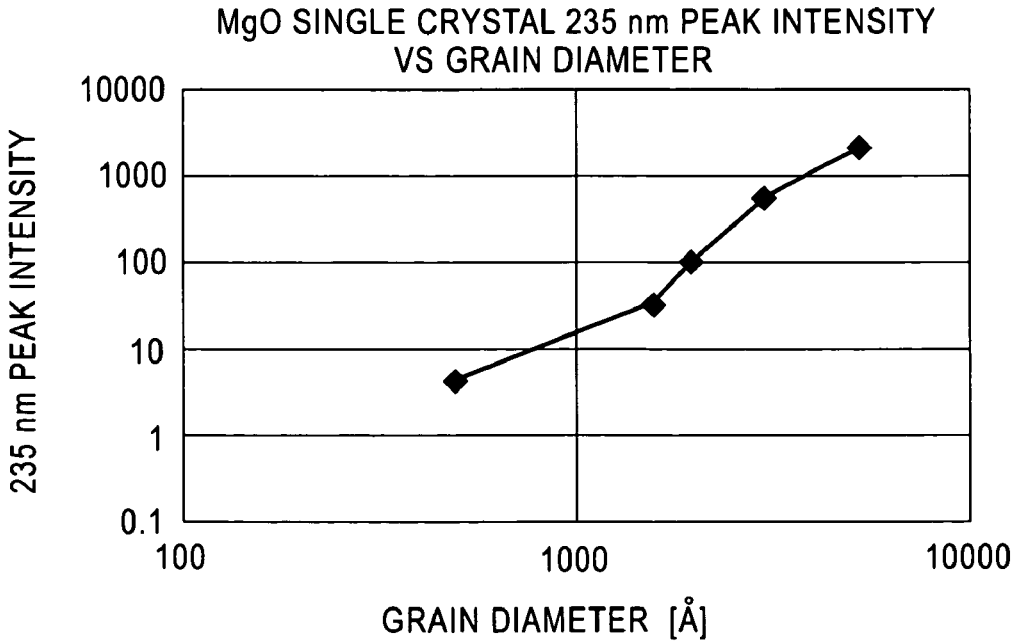
FIG. 14 is a graph showing the relationship of the grain diameter of magnesium oxide single crystal and the intensity of CL light emission at 235 nm.

Here, as described above, the vapor phase based magnesium oxide single crystal included in the magnesium oxide layer 13 formed in each display cell PC is excited by electron beams irradiated thereto to emit CL light which has a peak in a wavelength range of 200 to 300 nm (particularly, near 235 nm in a range of 230 to 250 nm) as shown in FIG. 13. As illustrated in FIG. 14, the CL light emission presents a larger peak intensity as the vapor phase based magnesium oxide crystal has a larger grain diameter. Specifically, as magnesium is heated at temperatures higher than usual when vapor-phase magnesium oxide crystals are produced, single crystals having a relatively large grain diameters of 2000 angstroms or more, as shown in FIG. 5 or 6, are formed together with vapor-phase magnesium oxide single crystals having an average grain diameter of 500 angstroms. In this event, since the magnesium is heated at temperatures higher than usual, a flame associated with the reaction of magnesium with oxygen also becomes longer. Consequently, a larger temperature difference is produced between the flame and ambient, so that it is estimated that a group of magnesium oxide single crystals having larger diameters include more single crystals which exhibit high energy levels corresponding to 200-300 nm (particularly, 235 nm).

Figure 15:
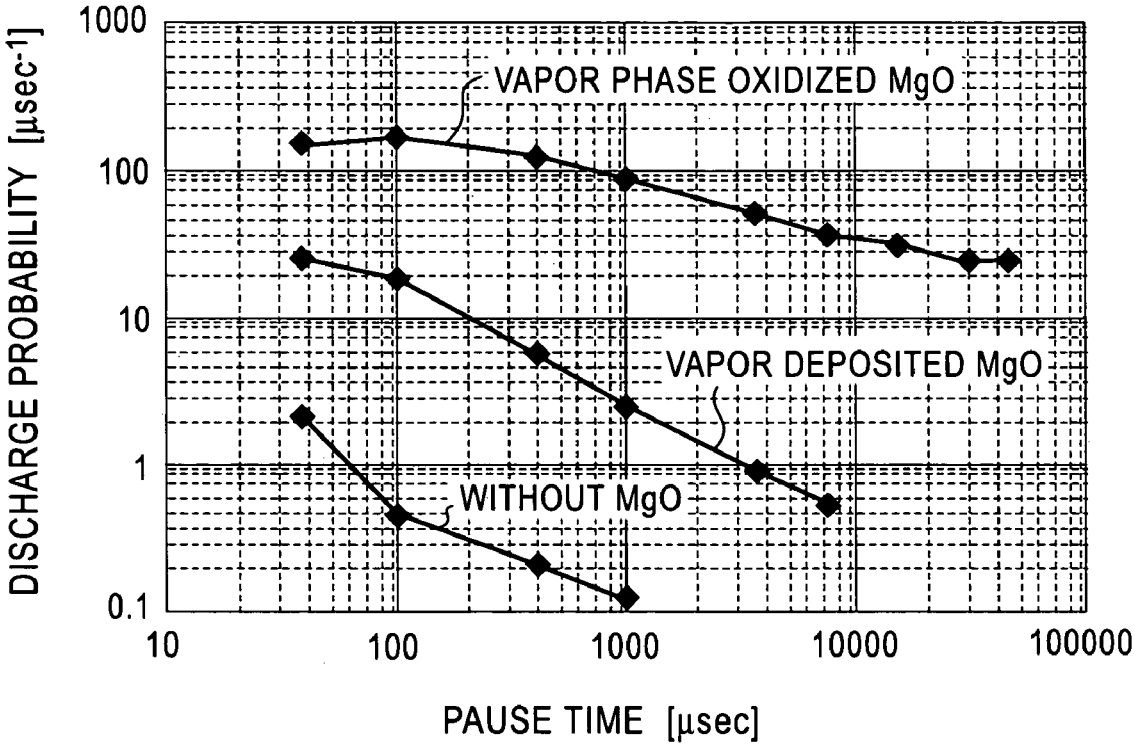
FIG. 15 is a diagram showing a discharge probability when no magnesium oxide layer is provided within a display cell; a discharge probability when a magnesium oxide layer is deposited by a conventional vapor deposition; and a discharge probability when a magnesium oxide layer including vapor-phase magnesium oxide single crystal is provided.

FIG. 15 is a diagram showing a discharge probability when the display cell PC is not formed with a magnesium oxide layer, a discharge probability when the display cell PC is formed with a magnesium oxide layer in accordance with a conventional vapor deposition method, and a discharge probability when the display cell PC is formed with a magnesium oxide layer including magnesium oxide single crystals which involve CL light emission having a peak in a range of 200-300 nm (particularly, near 235 nm in a range of 230 to 250) with irradiation of electron beam. In FIG. 15, the horizontal axis represents a discharge pause time, i.e., a time interval from the time a discharge is produced to the time the next discharge is produced.

Figure 16:
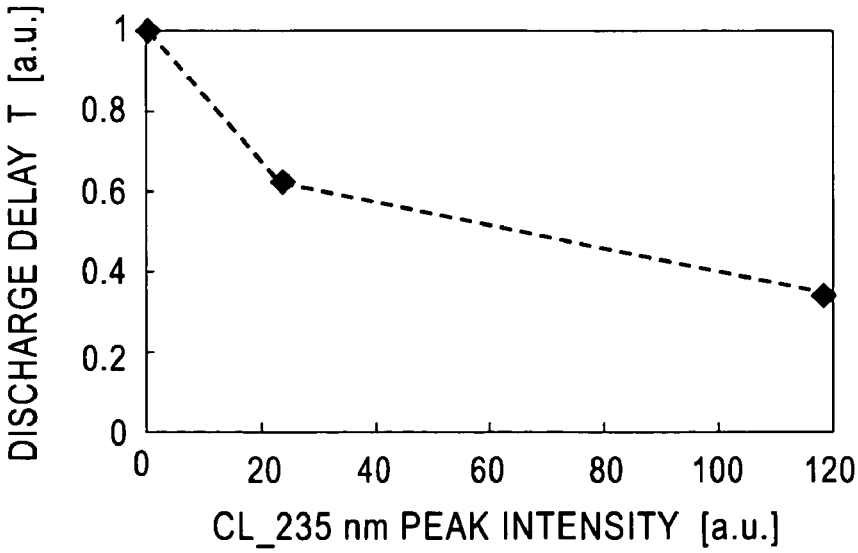
FIG. 16 is a diagram showing a correspondence relationship between a peak intensity of CL light emission at 235 nm and a discharge delay time.

As shown, when each display cell PC contains the magnesium oxide layer 13 including vapor phase based magnesium oxide single crystals which, when irradiated with an electron beam, involve the CL light emission having a peak in a range of 200-300 nm (particularly, near 235 nm in a range of 230 to 250), as shown in FIG. 5 or 6, the discharge probability is increased as compared with the magnesium oxide layer formed by a conventional vapor deposition method. As shown in FIG. 16, the vapor-phase magnesium oxide single crystals can reduce a delay in a discharge produced in the discharge space S as it has a higher intensity of the CL light emission, particularly, the CL light emission having a peak at 235 nm when irradiated with an electron beam.

Therefore, even when a faint reset discharge is produced by applying the row electrodes with the reset pulse $RP_Y$ which slowly changes in voltage as shown in FIG. 12 with the intention of limiting light emission associated with a reset discharge which is not involved in a displayed image to improve the contrast, this faint reset discharge can be produced for a short time with stability. Particularly, since each display cell PC employs the structure which locally produces a discharge near a discharge gap between the T-shaped transparent electrodes Xa and Ya, this structure prevents a strong and eruptive reset discharge which would occur in the entire row electrodes and a strong erroneous discharge between the column electrode and row electrode.

Also, a higher discharge probability (less discharge delay) permits the priming effect, resulting from the write reset discharge and erasure reset discharge in the reset stage R, to last for a long time, so that a faster addressing discharge is produced in the addressing stage W.

Consequently, the addressing discharge can be correctly produced even if the column electrode D of the PDP 50 is applied with the pixel data pulse DP having a lower peak voltage. Accordingly, when the pixel data pulse generator circuit 22 generates the pixel data pulse DP with a lower peak voltage, reduced power is consumed by the pixel data pulse generator circuit 22. As a result, reduced heat is generated in the driver module DM, as shown in FIG. 11, in which the pixel data pulse generator circuit 22 is contained, thus making it possible to reduce the size of or eliminate a radiator which should be mounted to the driver module DM.

In FIG. 1, the column electrode driving circuit 55 is positioned above the screen of PDP 50, but may be positioned below the screen. In essence, the flexible cables FL1-FL4, circuit boards K1-K4, and driver modules DM1-DM4 may be formed on one side above the screen of the PDP 50 or on one side below the screen.

Also, the foregoing embodiment has been described in connection with a so-called selective write addressing method which is employed for driving the PDP 50 to display halftone images, by initializing the display cells to the state in which a predetermined amount of wall charge does not remain (reset stage R), and selectively forming a predetermined amount of wall charge in each display cell based on an input video signal (addressing stage W). However, a so-called selective erasure addressing method may be employed instead for driving the PDP 50 to display halftone images, by forming a predetermined amount of wall charge in all the display cells (reset stage R), and selectively erasing a predetermined amount of the wall charge formed in each display cell in accordance with pixel data (addressing stage W).

Also, in the foregoing embodiment, the PDP 50 employs the structure in which the display cell PC is formed between the electrode X and the electrode Y which together form a pair such as the row electrode pair $(X_1, Y_1), (X_2, Y_2), (X_3, Y_3), \ldots, (X_n, Y_n)$, but the PDP 50 may employ a structure in which the display cells PC are formed between all row electrodes adjacent to each other. In essence, the PDP 50 may employ a structure in which the display cells PC are formed between the row electrodes $X_1$ and $Y_1$, between the row electrodes $Y_1$ and $X_2$, between the row electrodes $X_2$ and $Y_2$, . . . , between the row electrodes $Y_{n-1}$ and $X_n$.

Further, in the foregoing embodiment, the PDP 50 employs the structure in which the front transparent board 10 is formed with the row electrodes X, Y, while the back board 14 is formed with the column electrodes D and fluorescent layer 17, respectively. Alternatively, the PDP 50 may employ a structure in which the row electrodes X, Y are formed on the front transparent board 10 together with the column electrodes D, and the fluorescent layer 17 is formed on the back board 14.

Furthermore, while the foregoing embodiment has illustrated the configuration which employs the resonance pulse power supply circuit 21 as a power supply circuit, the present invention is not so limited, but a DC power supply may be employed and connected to a power supply line.

This application is based on Japanese Patent Application No. 2004-362697 which is hereby incorporated by reference.

What is claimed is:

1. A plasma display device for driving, in accordance with pixel data based on an input video signal on a pixel-by-pixel basis, a plasma display panel formed with a capacitive display cell constituting a pixel at each of intersections of a plurality of row electrode pairs with a plurality of column electrodes intersecting with each of said row electrode pairs and extending in the intersecting direction, said device comprising:

a magnesium oxide layer formed on a surface in contact with a discharge space in each of said display cells and including a magnesium oxide crystal exposed to said discharge space, said magnesium oxide crystal having a characteristic to emit cathode luminescence light having a peak in a wavelength range of 200 to 300 nm when excited by an electron beam irradiation; and a pixel data pulse generator circuit for connecting said column electrodes to a power supply line in accordance with the pixel data to generate a pixel data pulse, and applying the pixel data pulse to said column electrodes, wherein said pixel data pulse generator circuit comprises a plurality of IC chip circuits, and each of said IC chip circuits is mounted on one of a plurality of flexible wiring boards connected to the power supply line and said column electrodes.

2. A plasma display device according to claim 1, further comprising a resonance pulse power supply circuit formed on a circuit board disposed on the back of said plasma display panel for generating a resonance pulse supply voltage, the potential of which varies over a predetermined resonance amplitude, and applying the resonance pulse supply voltage to said power supply line.

3. A plasma display device according to claim 1, wherein said magnesium oxide crystals have a grain diameter of 2000 angstrom or more.

4. A plasma display device according to claim 1, wherein said magnesium oxide crystals include magnesium oxide single crystals generated by heating magnesium to generate a magnesium vapor, and oxidizing the magnesium vapor in vapor phase.

5. A plasma display device according to claim 1, wherein said magnesium oxide crystals emit cathode luminescence light having a peak in a wavelength range of 230 to 250 nm.

6. A plasma display device according to claim 1, wherein said magnesium oxide layer is formed on a dielectric layer which covers said row electrode pairs.

* * * * *